United States Patent [19]

Sickles

[11] Patent Number: 5,044,564

[45] Date of Patent: Sep. 3, 1991

[54] ELECTROSTATIC SPRAY GUN

[76] Inventor: James E. Sickles, 21889 Potomac Dr., Southfield, Mich. 48076

[21] Appl. No.: 439,842

[22] Filed: Nov. 21, 1989

[51] Int. Cl.[5] ..... B05B 5/043

[52] U.S. Cl. ..... 239/690.1; 239/705; 239/707

[58] Field of Search ..... 239/690, 690.1, 691, 239/692, 696, 704, 705, 706, 707, 708

[56] References Cited

U.S. PATENT DOCUMENTS

| | | | |
|---|---|---|---|
| 2,302,185 | 11/1942 | Campbell, Jr. . | |
| 2,959,353 | 11/1960 | Croskey et al. | 239/707 |
| 3,613,993 | 10/1971 | Gourdine | 239/707 |
| 3,698,634 | 10/1972 | Hamilton, Jr. . | |
| 3,731,145 | 5/1973 | Senay . | |
| 4,009,829 | 3/1977 | Sickles . | |
| 4,073,002 | 2/1978 | Sickles et al. . | |
| 4,106,697 | 8/1978 | Sickles et al. . | |
| 4,120,017 | 10/1978 | Sickles . | |
| 4,157,162 | 6/1979 | Benedek et al. | 239/707 |
| 4,186,886 | 2/1980 | Sickles | 239/705 |
| 4,255,777 | 3/1981 | Kelly . | |
| 4,266,721 | 5/1981 | Sickles . | |
| 4,290,091 | 9/1981 | Malcolm . | |
| 4,313,968 | 2/1982 | Sickles et al. . | |
| 4,331,298 | 5/1982 | Bentley et al. . | |
| 4,343,433 | 8/1982 | Sickles . | |
| 4,347,984 | 9/1982 | Sickles . | |
| 4,381,533 | 4/1983 | Coffee | 239/690 |
| 4,440,349 | 4/1984 | Sickles et al. . | |
| 4,572,438 | 2/1986 | Traylor . | |
| 4,611,762 | 9/1986 | Turner et al. . | |
| 4,745,520 | 5/1988 | Hughey . | |
| 4,761,299 | 8/1988 | Hufstetler et al. . | |

OTHER PUBLICATIONS

"Spray Painting Equipment", *Products Finishing,* pp. 79–85, Mar. 1987.

"Trends in Electrostatic Hand Guns", *Products Finishing,* pp. 86–93, Mar. 1987.

"Should You Consider Air-Assisted Airless Spray?", *Products Finishing,* pp. 59–64, Jan. 1989.

"Spraying Water-Borne Coating Electrostatically", *Products Finishing,* pp. 48–56, Jan. 1989.

*Primary Examiner*—Andres Kashnikow
*Assistant Examiner*—Karen B. Merritt
*Attorney, Agent, or Firm*—Jones, Tullar & Cooper

[57] ABSTRACT

An adapter for converting spray guns to electrostatic or induction charging includes a housing mountable on a spray gun. A high voltage power source is contained in the housing and is connected to an electrode assembly mounted on the front of the housing. The electrode assembly includes four electrodes which extend in front of the spray gun nozzle and air cap and are spaced symmetrically around the spray axis. The nozzle is electrically grounded, while the electrodes carry a voltage in the range of 3–15 kV, to produce in the spray path from the nozzle an electrostatic field which produces electrical charges on the sprayed particles. When conductive liquids are sprayed, the particles are charged by induction at relatively low electrostatic field gradients, while nonconductive liquids require high electrostatic field gradients which produce corona effects. These corona effects are enhanced by the provision of a corona needle mounted on the nozzle at the spray axis.

41 Claims, 9 Drawing Sheets

ELECTROSTATIC SPRAY GUN

BACKGROUND OF THE INVENTION

The present invention relates, in general, to electrostatic spray guns, and more particularly, to an adapter for converting hand held airless, air assisted, or air-atomization spray guns to electrostatic or induction charging operations, or to a combination thereof, to provide improved spraying of, for example, electrically conductive or nonconductive coating materials such as high solid, water borne, metallic powder, or two-component paints, pyrolitic solutions, and the like.

Conventional airless, air assisted, or air atomization spray guns, such as those manufactured by Binks Manufacturing Company and others, incorporate a spray nozzle which includes liquid passageways and some mechanism for atomizing the liquid. The liquid, which may be paint, for example, flows under pressure through a central passage in the spray nozzle for discharge through a central orifice. This liquid flow is controlled, typically, by a fluid control needle valve located in the central passage, and the liquid is atomized as it is discharged. In an air assisted or air atomized spray gun, air passages are provided near the central fluid flow passage to assist in the atomization and to control the direction and flow pattern of the liquid particles. Thus, air under pressure coacts with the liquid ejected from the liquid outlet to further atomize the liquid and to impel the droplets outwardly away from the spray gun nozzle. Typically, the air flow is controlled by an air cap which surrounds the liquid outlet aperture. For example, the air cap may provide an annular air orifice surrounding the liquid outlet, may include additional air outlets around the air orifice, and may include a pair of forwardly projecting air horns which incorporate additional air nozzles directed generally inwardly toward the axis of the atomized spray to control its pattern. Typically, these air horns direct the atomized spray in a fan pattern to facilitate operation of the spray gun, with the air cap being rotatable on the spray gun to provide, for example, a vertical fan or a horizontal fan pattern.

When conventional spray guns of the foregoing types are used for spraying materials such as paint having a high solids content, metallic paints, and the like, problems are encountered, since such spray guns have low transfer efficiencies; for example, from 15 to 30 percent for an air-atomized paint spray, resulting in a great deal of wasted material. Improvements, including a greatly increased efficiency, have been obtained through electrostatic charging of the atomized coating material, such charging providing, for example, an efficiency in the range of 45 to 75 percent for electrostatic air atomized spray devices and from 90 to 99 percent for electrostatic rotary bell spray devices. However, even electrostatic devices present problems, particularly when spraying a conductive material such as water based paint, for it is necessary to electrically isolate such systems to prevent high voltages from endangering users or causing electrical discharges which could result in explosions. Various techniques have been provided for producing such isolation, such as isolating the paint supply from ground to prevent the high voltage that is being applied to the atomizer from leaking to ground through the paint supply line, utilizing a reverse charging process where the part being coated is placed at a high charge with the spray gun being at ground potential, or by utilizing an external charging system. Difficulties have been encountered in each of these systems, however, although external charging techniques utilizing, for example, a charging ring surrounding a rotary atomizer, have provided significant improvements in the application of water-borne coatings. The use of such a system has had limited use on high speed motion machines, and difficulties have been encountered in providing effective external charging of atomized coating particles with hand-held spray guns. Numerous attempts have been made to provide an external charging system for a hand-held spray gun that would effectively charge a wide variety of coating materials, including both electrically conductive and nonconductive materials, so as to produce a high transfer efficiency as well as to produce satisfactory spray coatings.

Most prior hand held electrostatic spray devices have in common a spray gun to which is mounted a high voltage electrode disposed adjacent the spray discharge point and carrying an electrical potential in the neighborhood of 50 to 85 kilovolts, and in some instances as high as 150 kilovolts. The voltage on this electrode creates a corona discharge condition, and the resulting electric field creates a region rich in ions through which the spray particles must pass. Some of these ions become attached to the spray droplets, producing electric charges on the particles which may then be directed toward a workpiece which is electrically grounded and which therefore attracts the charged particles. In addition, liquid contact with the metal spray nozzle or with a centrally located needle electrode also produces charges on the liquid and contributes to the overall charging of the particles.

Such corona discharge devices present numerous difficulties, principally as a result of the very high voltages required to produce effective operation. First of all, these high voltages usually are produced by separate electronic high voltage power supplies which are relatively large, heavy and expensive. Furthermore, because of the high voltages involved, the cable interconnecting the power supply and the spray gun charging electrode necessarily has to be heavily insulated and thus is bulky, relatively inflexible, and very expensive. The size and weight of the power supply and its cable substantially restricts the usefulness of the conventional corona effect spray gun both because of the difficulties encountered in handling and moving it, and the high cost.

Attempts have been made to overcome this problem, for example, through the use of turbine-driven voltage generators mounted in the spray gun and driven by the air flow to the nozzle. However, this requires extremely clean air, or the turbine becomes clogged, so large and expensive air filters are required. However, even these filters can become clogged and this reduces the air pressure to the gun. Other attempts have involved the use of high voltage ladder networks driven by conventional 110 voltage power connected through a relatively small cable. However, the very high voltages required in prior devices has caused problems due to dielectric breakdown caused, in part, by solvent erosion of the dielectric and potting compound materials. Such problems result in high costs, not only to meet quality control requirements to produce operable devices, but because of the resultant shortened lifetime of the equipment.

The use of high voltages in excess of 50 kV is hazardous not only because of the possibility of creating electrical arcs when the gun is moved near grounded objects, but because of the possible danger to the operator should he inadvertently touch the high voltage electrode. Finally, the high voltages used in such systems create a current flow of excess ions which travel to nearby objects, resulting in undesired charge build up on such objects that are not adequately grounded. The hazard of sparking and consequent fire exists when the operator or some other grounded object is brought close to such a charged object. Further, the migration of such charges causes an undesired build up of the charged spray particles on objects other than the workpiece. Attempts to control such hazards result in complex ground sensing circuits, which reduce current flow to prevent arcing, as described in U.S. Pat. No. 4,745,520.

It has been found that effective electrostatic spray coating can also be accomplished through the use of induction charging apparatus which eliminates the need for the very high voltages used in the corona discharge type of electrostatic charging. Induction charging of liquid particles in spray discharge devices has been accomplished by surrounding the discharged spray with a static electric field which has an average potential gradient in the range of about 5 to 30 kilovolts per inch, with the liquid being held at or near ground potential. In such devices, the spacing between the liquid and the source of potential is made sufficient to prevent an electrical discharge so that a capacitive effect produces a static field. This field induces on liquid particles produced within the field electrical charges having a polarity which is opposite to that of the applied voltage. The resulting charged particles can then be directed, for example, at an electrically grounded workpiece to provide a coating of the liquid on the workpiece. Such induction charging techniques have been found to be particularly useful in spray systems utilizing electrically conductive liquids such as water based paints, since the liquid supply can be electrically grounded. This is a considerable improvement over the above-described corona discharge and other high voltage spray devices which utilize a high voltage needle electrode in contact with the liquid. In such devices the liquid is at the same high voltage as the electrode, thereby requiring that the liquid supply be electrically isolated to prevent excessive current flow and to ensure the safety of the operator The lower voltages and the grounding of the liquid supply in an induction type of system eliminates the problems inherent in high-voltage isolated systems An adapter to convert conventional nonelectrostatic spray guns as well as the high voltage corona discharge type of spray gun to induction charging is disclosed in U.S. Pat. No. 4,009,829. The described adapter is generally tubular and surrounds the spray nozzle of a conventional hand held or automatic spray gun of either the electrostatic or non electrostatic type. The forward end of the adapter extends beyond the end of the spray nozzle and is in the form of two diametrically opposed, forwardly extending lobes, each of which carries a charging electrode on its interior surface. A high DC voltage is applied between these electrodes and the liquid being sprayed to establish an electrostatic field within the charging zone defined by the device. The voltage applied is less than that required to cause corona discharge, but is sufficient to produce in the region near the liquid being sprayed a potential gradient of sufficient value to ensure that charges are induced on the particles sprayed from the nozzle.

The average potential gradient between the electrodes and the liquid supply in the device of the '829 patent is the average value of the voltage change per unit of radial distance between the axis of the liquid stream and the electrodes. The actual potential existing at any given point within the charging zone will depend upon the configuration of the electric field, and this will be influenced by factors such as the size and shape of the electrodes, the shape of the surface of the liquid stream, and the amount and location of the charge carried by spray particles within the zone. In the aforesaid U.S. Pat. No. 4,009,829, each charging electrode is in the form of a curved dielectric mounting plate carrying on its inner surface an electrically conductive metallic film, foil, or the like, and each mounting plate is secured to a corresponding lobe, but in spaced relationship to the lobe, to support the electrodes so as to define the charging zone. The curved electrodes are concentric to the axis of the spray nozzle to produce the desired electrostatic field configuration.

Similar adapters are illustrated and described in U.S. Pat. Nos. 4,073,002, 4,106,697, 4,186,886, 4,266,721, 4,313,968, 4,343,433, and 4,440,349, and in all of these patents the applicant herein is one of the named inventors. All of these patents disclose induction adapters either with or without corona assist. However, these devices generally require the use of a dielectric, such as plastic, air cap to prevent arcing or flashover between the electrodes and the spray gun. Such caps are more subject to abrasion and wear, and thus are less desirable than the conventional metal air cap. In addition, plastic air caps are more costly than metal caps, and are not available in the abundant variety of metal caps. Furthermore, prior spray gun devices required the use of high voltage cables or power supplies which are not only awkward to use, but present additional hazards to the user. Conventional high voltage electrostatic sprayers also present difficulties with certain coating materials. For example, conventional electrostatic sprayers produce lower concentrations and non-uniform distribution and/or orientation of metallic flakes in base coat applications, with the result that such coatings demonstrate poor color control and appearance when compared to conventional non-electrostatic air spray applied coatings. Furthermore, prior air electrostatic spray devices suffered from an excessive accumulation of droplets of the coating material on the spray gun. This is not only an inconvenience to the operator, but results in a loss of coating efficiency.

SUMMARY OF THE INVENTION

The present invention overcomes the difficulties encountered with prior devices by providing a charging adapter system for a conventional spray gun of the airless, air assisted, or air atomized spray type and which permits the charging of liquid sprays by induction and/or corona, depending upon whether the material to be sprayed is a conductive liquid, a partially conductive liquid, or a nonconductive liquid. The charging adapter system is entirely self-contained, and includes a high voltage power supply, batteries, and a photovoltaic power source and battery recharging system which can be mounted on a conventional spray gun to eliminate the need for any power cables. The power source for the system may utilize solar cells which directly power the adapter in bright sunlight, while for indoor use, the adapter is powered by batteries which are recharged by the indoor lighting, or by an AC/DC converter.

The adapter of the present invention utilizes a symmetrical electrode configuration which is mounted on a conventional spray gun having either a conventional metal spray cap or a conventional plastic spray cap and surrounding a fluid nozzle, the symmetry of the electrode configuration allowing the air cap to be positioned so that the spray fan opens either vertically or horizontally without affecting the charging efficiency of the device. The electrodes are in front of the spray cap, and are close to the liquid flow stream so that the field lines are essentially unaffected by the proximity of a metal spray cap. Although there might be some flashover to the metal cap occurring before the start of liquid flow, this can be controlled easily by providing shielding such as a nonconductive tape or film on selected portions of the metal cap. Such a coating applied to the cap prevents arcing, and also increases the concentration of the field lines at the liquid stream atomizing sites.

Maximum safety in operation is achieved with a relatively low voltage, low capacitance design, in addition to the use of ground shields located forwardly of the charging electrodes to prevent the operator or other grounded objects from coming into contact with the electrodes. The forward projecting ground shields further serve to establish non uniform electric fields around the adapter assembly to deflect charged droplets which would otherwise accumulate on the spray gun and drip, or "slug", from it during spraying.

The adapter provides automatic switching of the charging mechanism in response to the type of liquid being sprayed. Thus, the charging mechanism is pure induction for very conductive materials such as waterborne paints, and gradually shifts to corona as the liquid conductivity decreases to nonconductive, as when nonpolar solvent based paints are used. The liquid reservoir is always maintained at ground potential, further increasing the safety of the device.

The electrode configuration of the present invention produces electric fields which are predominantly parallel to the surface being painted. During atomization and transport of the particles, this field arrangement assists in prealigning the metal flakes in a paint or other coating material containing such flakes, so that the flakes are properly aligned when they strike the workpiece. Induction charging by its nature does not produce free ions in the atomized spray, although conventional corona discharge systems do produce such ions at high voltages. However, the lower voltage used in the present adapter system as well as the automatic switching of the charging mechanism between induction and corona in accordance with the conductivity of the liquid being sprayed results in a substantial absence of free ions in the spray cloud. Those ions which are produced are attracted to the ground shields, so that free ions are substantially eliminated, in contrast to conventional high voltage corona guns, and this contributes to a more uniform deposition of the charged droplets on the workpiece. Furthermore, the finer atomization produced by induction charging segregates out the small flake particles in metallic flake paints, and preferentially deposits the larger flake particles on the workpiece surface with the proper alignment to produce the desired appearance, but at a much higher deposition efficiency than can be attained through nonelectrostatic airsprays.

In general, the adapter of the present invention consists of a charging assembly which includes four electrodes attached to the ends of two C-shaped support heads. The electrodes are preferably a semiconducting plastic, although they may be formed of a dielectric material with a thin semi-conductive coating. The support heads in turn are removably mounted on an adapter housing which is secured to a conventional non-electrostatic paint spray gun for converting it to electrostatic operation. The adapter housing incorporates two side modules, one containing a high voltage power supply and the other a rechargeable battery pack. A solar cell panel may be attached to the outwardly facing surface of each side module and a third solar cell panel may be attached to the top of the housing, bridging across the two side modules. The housing is secured on the spray gun so as to position the electrodes close to, but spaced radially outwardly from the spray axis of the spray gun nozzle, and in front of the front surface of the spray gun air cap.

Portions of the metal air cap may be coated with a fused dielectric plastic film, such as Teflon, in areas immediately adjacent to the location of the electrodes. Areas of the cap immediately adjacent to atomizing and shaping ports would not normally be coated, since such a coating could produce changes in the air flow that would produce a misshapen spray fan.

A conventional metal liquid nozzle is preferably used for the spray gun, with a small wire corona needle attached to extend into the liquid spray path, preferably extending a short distance along the spray axis. The needle assists in the formation of liquid droplets, and preferably is sharpened or shredded to produce one or more sharp filaments or points at its forward tip to produce maximum corona effects.

BRIEF DESCRIPTION OF THE DRAWINGS

The foregoing and additional objects, features and advantages of the present invention will become apparent to those of skill in the art from a more detailed consideration of preferred embodiments thereof, taken in conjunction with the accompanying drawings, in which.

DESCRIPTION OF PREFERRED EMBODIMENTS

Figure 1:
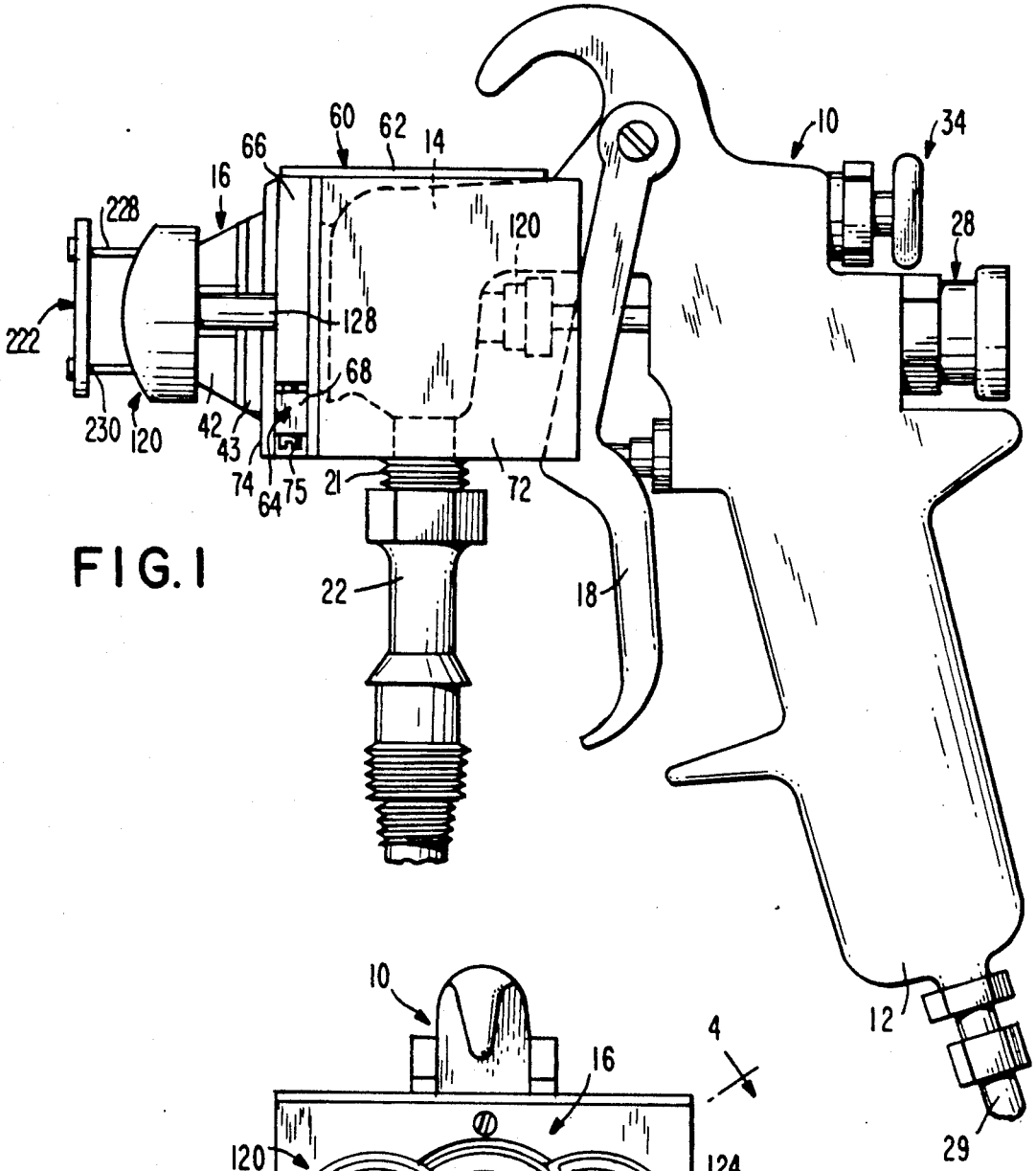
FIG. 1 is a side elevation view of a conventional spray gun incorporating the adapter of the present invention.
Figure 3:
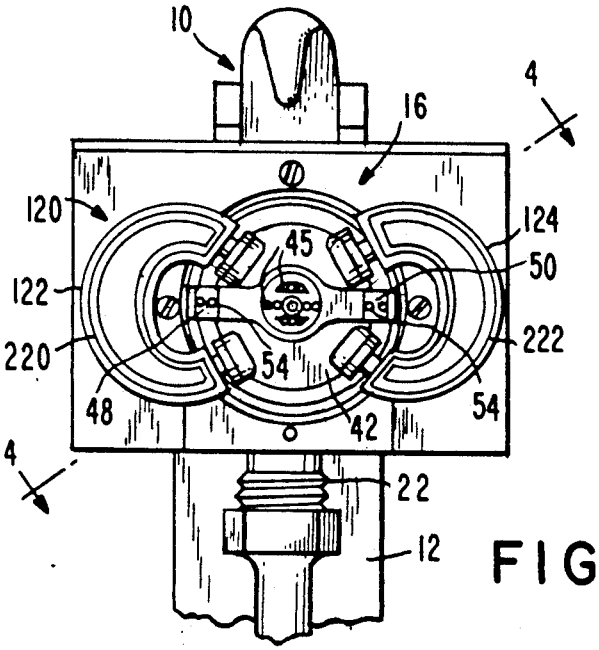
FIG. 3 is a front elevation view of the spray gun and adapter of FIG. 1.

Referring now to the drawings, and in particular, to FIGS. 1-4, there is illustrated at 10 a conventional air-operated spray gun having a handle portion 12, a barrel 14 and a nozzle assembly generally indicated at 16. The illustrated spray gun is a hand held device having a conventional trigger 18 which operates a valve assembly 20 to admit liquid from a pressurized supply source, a siphon feed source, or the like (not shown) to the gun. The liquid is fed to the spray gun through a suitable connector 21 which may be threaded to receive a corresponding connector on a liquid feed hose 22 or the like leading from the liquid supply source. The valve 20 includes at its distal end a liquid control needle 23 (See FIG. 4) located in a liquid passage 24 within barrel 14 and nozzle 16, having at its distal end a valve seat 25 which receives the tapered end of the needle 23. The liquid to be sprayed passes through the liquid passageway 24, passes around the end of needle 23 at the seat 25 and is discharged as an atomized spray of droplets through a central aperture 26 at the end of passageway 24. The passageway 24 extends axially through a nozzle element 27 within nozzle 16, and the location of control needle 23 within the passageway is controlled manually by threaded adjuster knob 28.

A propellant or atomizing fluid such as air or another suitable gas is applied under pressure to the nozzle assembly 16 by way of an air hose 29 and through suitable passageways in the body of the spray gun. In order to provide the required degree of atomization and to regulate the discharge pattern of the spray, the air supply is fed to two separate passageways 30 and 32 illustrated in FIG. 4. The air flow in passageway 32 is adjusted by a manual control valve generally indicated at 34 in FIGS. 1 and 2 while the air flow in passageway 30 is controlled externally of the spray gun, by adjusting the pressure of the air supply.

In accordance with known spray nozzle construction, the air flow passageway 30 is directed to an annular chamber 38 defined between the forward end of the spray nozzle element 27 and the interior of an air cap 42. The air cap, which is secured to the spray gun nozzle 16 by a nut 43, incorporates a plurality of apertures, such as an annular aperture 44 surrounding the outlet port 26 of nozzle 27 and additional apertures or ports 45 at spaced locations around the aperture 44 (see FIG. 3), all of which cooperate to direct air from the chamber 38 out of the face of the nozzle assembly in such a way as to shape the flow of atomized liquid from the aperture 26, and to further atomize the liquid, in known manner.

The flow of air from passageway 32 is directed to an annular chamber 46, also defined by the air cap 42. The air cap illustrated in the present embodiment incorporates a pair of diametrically opposed air horns 48 and 50 (see FIGS. 2, 3 and 4) which extend forwardly from the discharge point of nozzle aperture 26 (to the left as viewed in FIG. 2 and to the right as viewed in FIG. 4). Each of the air cap horns contain air passageways, illustrated at 52 in air horn 50 in FIG. 4, which are connected to the annular chamber 46. These passageways serve to direct air out of inwardly facing air ports 54 (see FIGS. 2 and 3) generally toward the atomized liquid being discharged from nozzle aperture 26 and outwardly from the nozzle to shape the pattern of the liquid discharge. By regulating the rates of flow of the various streams of liquid and air, and by careful selection of the number and angles of the air exit ports formed in the air cap 42, a spray discharge having the desired shape and other characteristics may be produced. Typically, such air horn ports deflect the atomized particles into a fan shape which usually lies in a horizontal or a vertical plane for ease of use of the spray gun.

The adapter of the present invention includes an adapter housing indicated generally at 60 (FIGS. 5-8) which includes a top plate 62, a front mounting plate assembly 64 (FIG. 8) which includes an upper mounting plate 66 and a lower mounting plate 68, a power supply module 70 forming one side of the housing, and a battery pack module 72 forming the other side of the housing. The front wall of the housing also includes a face plate 74 which is secured to the upper mounting plate 66 and extends downwardly to cover the lower mounting plate 68. The lower mounting plate is secured to the upper mounting plate by suitable screws or bolts 75 inserted into threaded apertures 76 and 78 in the lower and upper plates, respectively, for clamping the housing onto the air gun 10.

Figure 7:
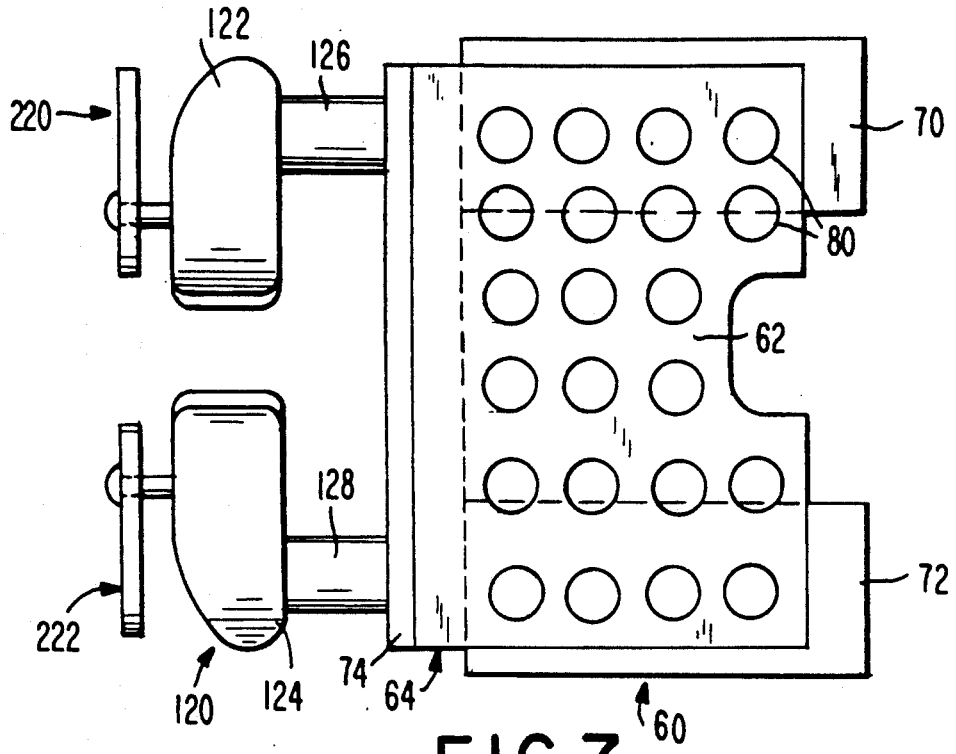
FIG. 7 is a top plan view of the adapter of the present invention.
Figure 8:
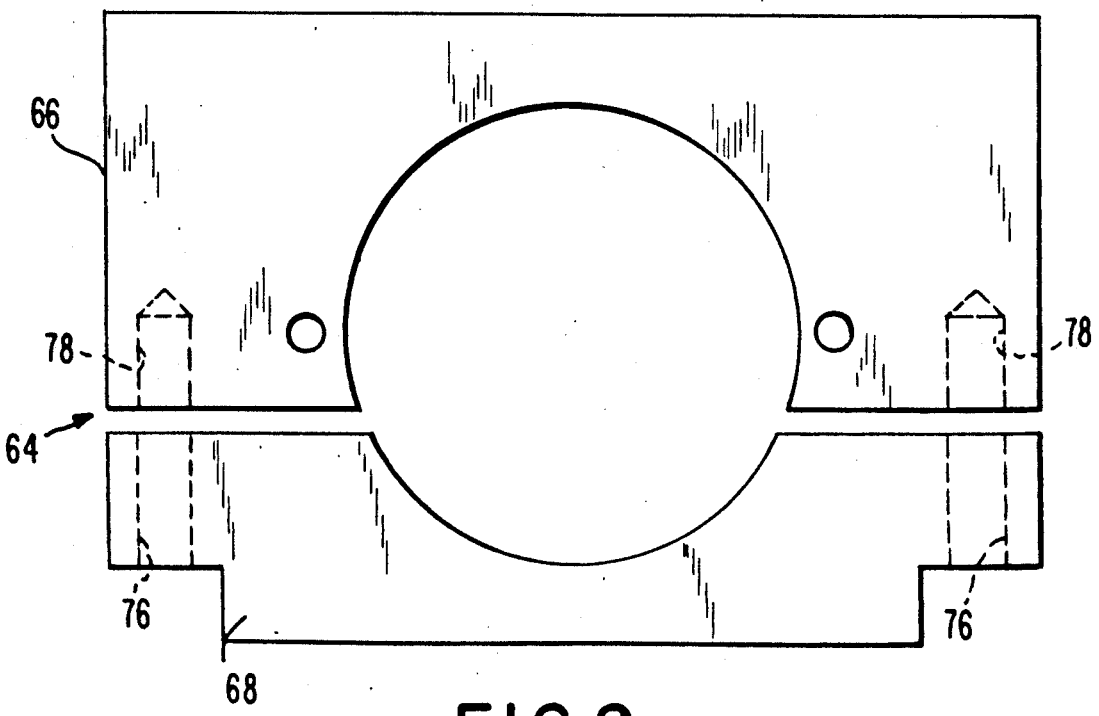
FIG. 8 is a front elevation view of an adapter mounting plate.

The top panel 62 carries a plurality of solar cells diagrammatically illustrated at 80 in FIG. 7, which cells serve to provide power to the rechargeable batteries in the battery pack carried by module 72 or, alternatively, may be used to supply power directly to the high voltage power supply carried in module 70. Additional solar cells may be provided on the outer side panels of modules 70 and 72. In a typical embodiment, each side panel may contribute an active solar cell area of about 16 square centimeters, while the top panel 62 may provide an additional 40 square centimeters. The power supply typically would require an input voltage of from 12 to 14 volts DC, requiring, for example, 10 Nicad AA cells of 1.2 volts each in series connection or 32 solar cells at 0.45 volts output per cell. The solar cells typically would deliver about 55 ma in full sunlight, depending on the particular cells used, and this might be sufficient to drive the adapter without the use of batteries. However, since the system would normally be used indoors, as for industrial and automotive painting, a lower solar cell output would be expected. Normal industrial lighting would provide an output equivalent to 10 to 20 percent of full sunlight, and this would produce approximately 5 to 12 ma of charging current which would be adequate to maintain the Nicad cells at full charge when left in a lighted area during nonuse periods. The batteries could also be charged with a conventional Nicad charger, but this has the disadvantage that an electrical cord must be connected to the adapter. However, the cord could be connected only during nonuse periods so that the adapter would retain its advantage of easy portability. It will be understood that if desired the solar panels, the batteries, and/or the entire power supply can be separately mounted, and connected to the adapter by a cable. In such a case, one power supply unit can supply several electrostatic sprayers, as, for example, in an automatic spray system or in a robotics system.

Figure 9:
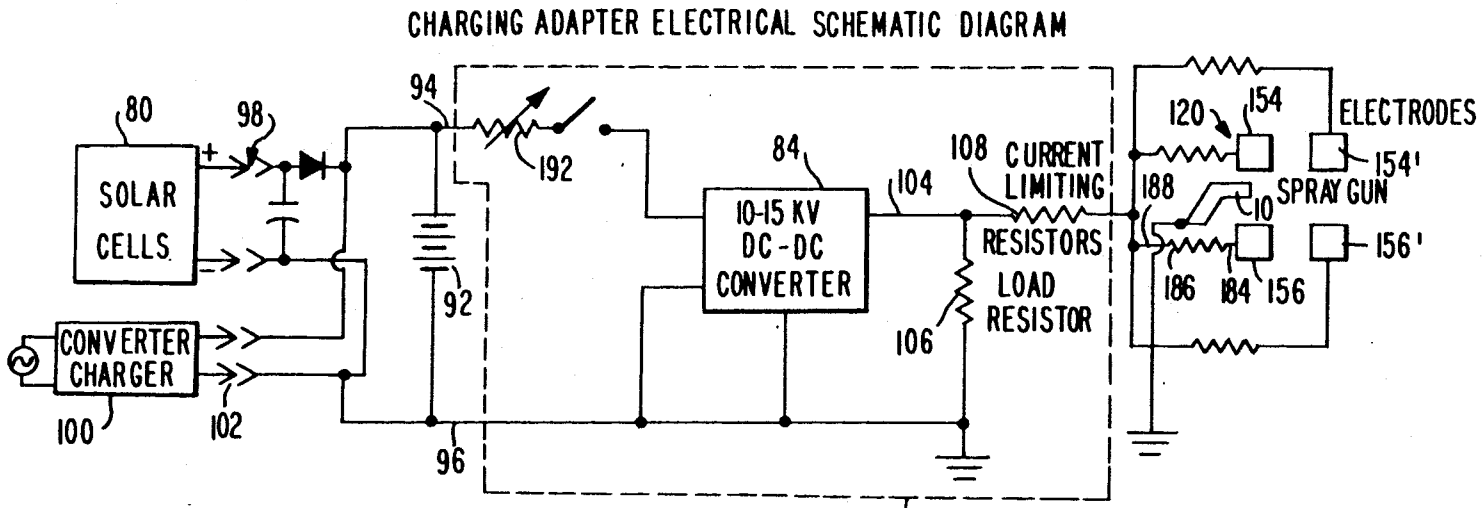
FIG. 9 is a schematic diagram of the charging circuit for the adapter of the present invention.
Figure 10:
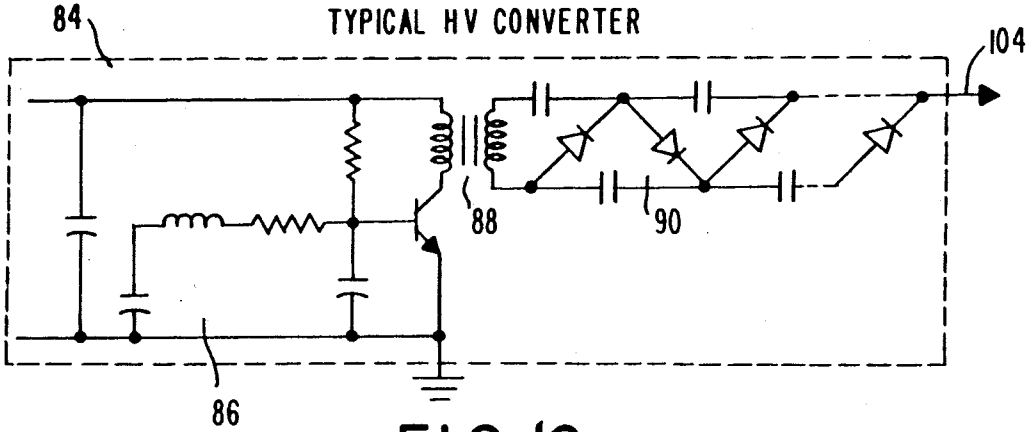
FIG. 10 is a circuit diagram of a typical high voltage converter circuit for use in the circuit of FIG. 7.

The power supply carried in module 70 is generally indicated at 82 in FIG. 9 and includes a high voltage DC to DC converter 84 of conventional design. The details of converter 84 are illustrated in FIG. 10, wherein the low voltage DC, for example 5 to 15 volts, is first converted to AC in oscillator circuit 86 and then is transformed to a high voltage AC by means of a high frequency transformer 88. Typically, the high voltage AC signal is further multiplied and converted to DC in a voltage multiplier ladder circuit 90.

The Nicad batteries 92 contained in the battery pack 72 are connected across the input lines 94 and 96 of the power supply to provide the required operating voltage for the converter 84. The solar cells 80 are connected across the batteries 92 by way of connector 98 or a conventional battery charger 100 may be connected to the batteries by way of connector 102.

The output voltage from converter 84 is supplied by way of line 104 across a load resistor 106 of, for example, 500 Megohms while a second 500 Megohm current limiting resistor is connected between line 104 and converter output line 110 which is connected to the charging electrodes carried on the adapter 60. The values of the load and current limiting resistors can vary, with the load resistor 106 being selected to provide a compromise between low current drain, which allows smaller and lighter batteries to be used, and keeping the power supply operating at high efficiency even under widely varying load conditions at the electrodes. The current limiting resistor 108 can also vary, with its value being selected to strike a balance between a slow delivery of charge to the electrode surfaces in case of accidental grounding, and a fairly rapid draining of charge from the electrode surface when the power supply is turned off.

Figure 4:
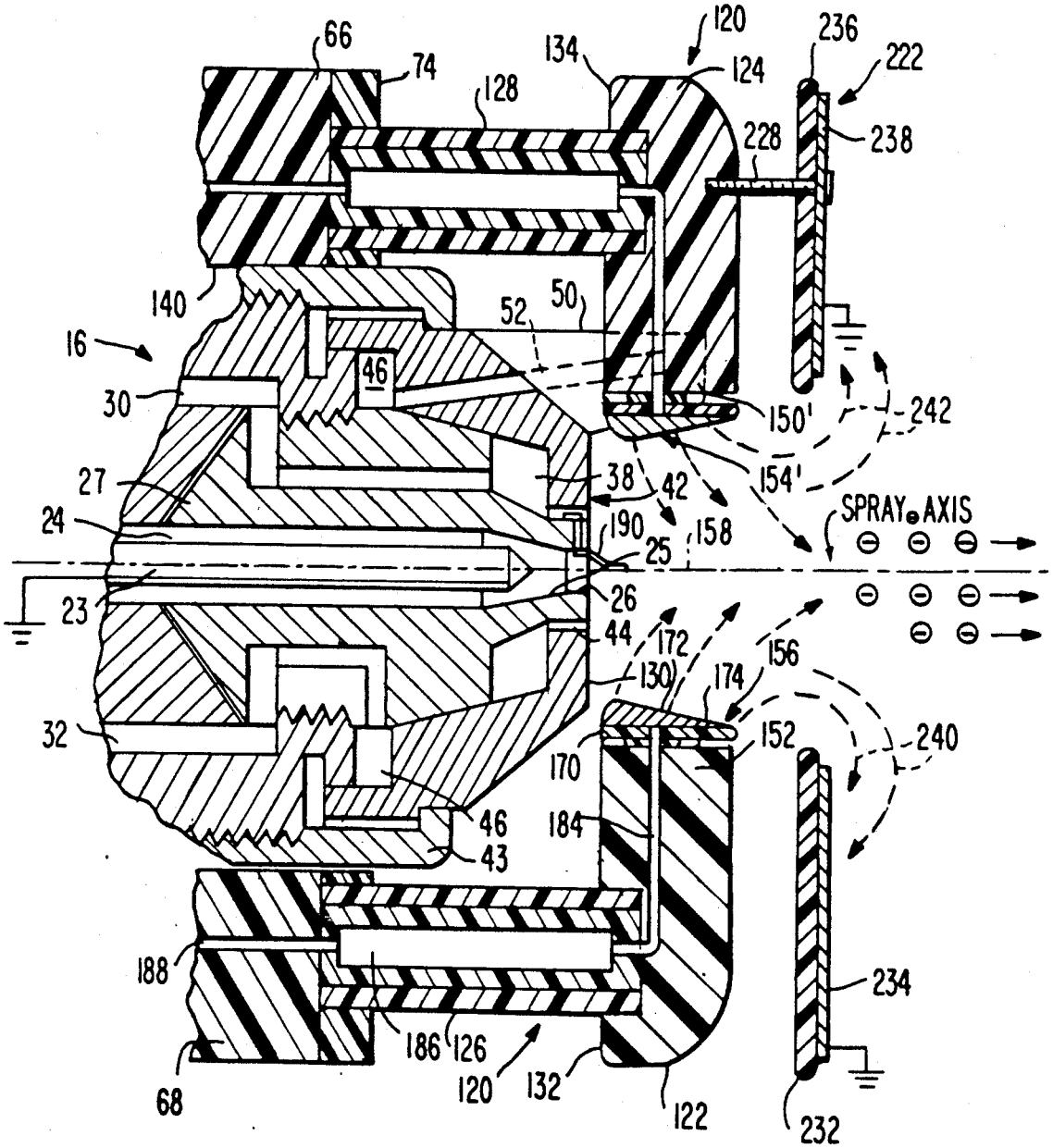
FIG. 4 is an enlarged cross sectional view of the spray gun and adapter of the present invention taken along line 4—4 of FIG. 3.
Figure 5:
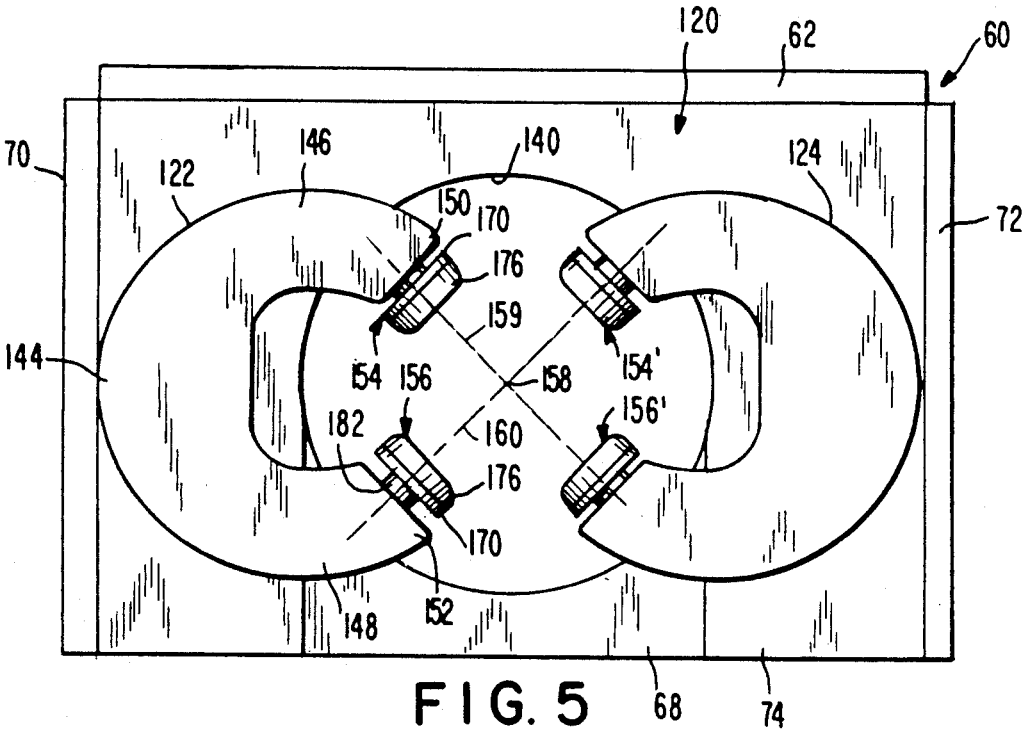
FIG. 5 is an enlarged front view of the adapter of the present invention detached from a spray gun.
Figure 6:
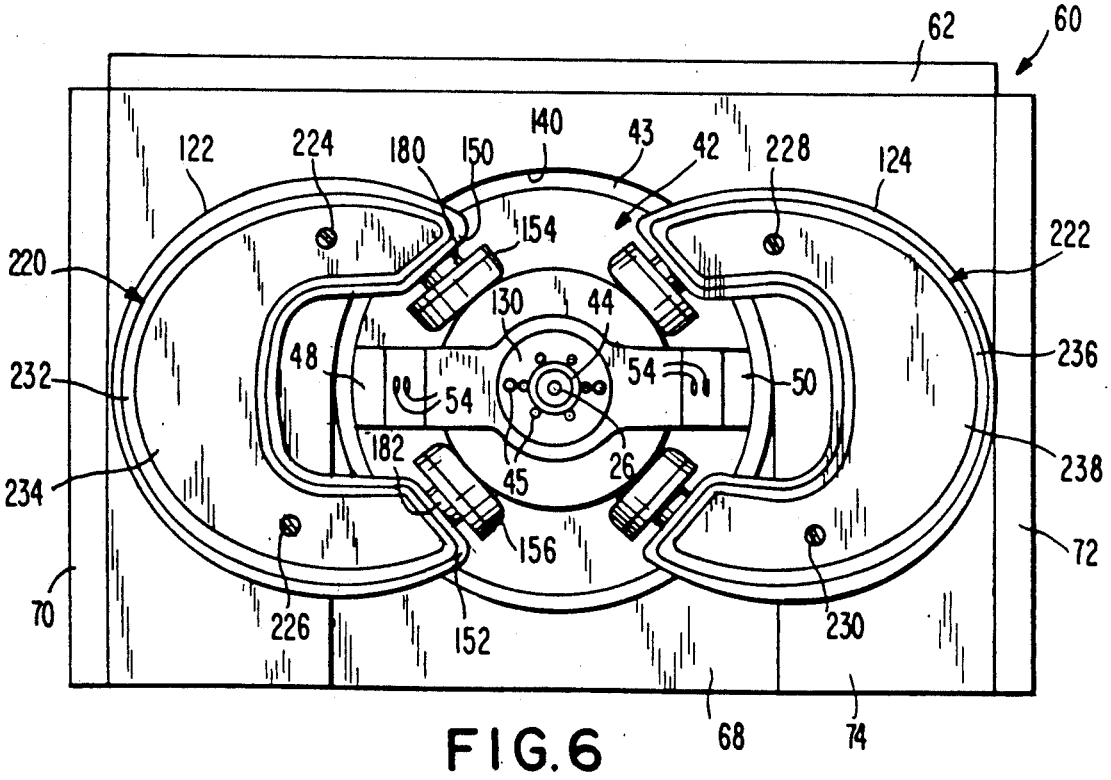
FIG. 6 is a front elevation of the adapter of FIG. 4, mounted on a conventional spray cap.

Mounted to the front surface of the face plate 74 is a charging electrode assembly 120. The electrode assembly includes a pair of C-shaped electrode support heads 122 and 124 (FIG. 5) removably secured by means of mounting posts 126 and 128, respectively (FIGS. 4 and 7) to the face of plate 74. The mounting posts 126 and 128 may be mounted by means of fasteners (not shown) and extend forwardly from the face plate by a distance sufficient to position the electrode assembly slightly in front of the forward surface 130 of the air cap 42, the rear faces 132 and 134 of support heads 122 and 124 lying in or slightly forward of a plane passing through the front surface 130 (see FIG. 4) of the air cap. The C-shaped support heads 122 and 124 are constructed of a solvent-resistant plastic having good dielectric properties such as an acetal resin. In addition, the face plate 74, the mounting plates 66 and 68, the power supply and battery modules 70 and 72, and the top panel all are constructed of a similar dielectric material. As illustrated in FIGS. 5 and 6, the face plate and mounting plate are formed with a central aperture 140 which fits over the air cap assembly 42 and in particular engages the outer periphery of the air cap securing nut 43, the upper and lower mounting plates 66 and 68, respectively, being secured around the air cap assembly by means of fasteners 75 (FIG. 1). The electrode assembly 120 is removable from the housing for replacement or repair, as necessary.

The C-shaped support heads are mirror images of each other, so only the head 122 will be described in detail. Head 122 includes a central body portion 144 (FIG. 5) and upper and lower arm portions 146 and 148 extending away from the central body portion and toward the central axis of the spray nozzle. The support head includes a pair of spaced distal ends 150 and 152, to which electrodes 154 and 156, respectively, are secured. The support head 122 is mounted on the face plate 74 in such a way that the distal ends 150 and 152 extend over the central aperture 140 in the face plate 74. When the adapter is mounted on the spray gun, the air cap 42 will extend through the aperture 140 in the manner illustrated in FIG. 6, and electrodes 154 and 156 will extend in front of the air cap, and inwardly toward the spray axis 158 of the air cap, as illustrated in FIGS. 4 and 6. Preferably, the ends of the support head tips 150 and 152 are perpendicular to radius lines 159 and 160, respectively, which pass through the axis 158 of the air cap 42. As illustrated in FIG. 5, the arrangement of the C-shaped support heads positions the electrodes 154, 156 and the corresponding mirror image electrodes 154' and 156' symmetrically about the axis 158 and spaced apart by 90 degrees. The spacing of the electrodes is such that the C-shaped support heads 122 and 124 straddle the spray head air horns 48 and 50, respectively, when the air horns are in the position illustrated. The air cap can be rotated 90 degrees, if desired, to change the plane of the fan-shaped spray, in which case the air horns are positioned between electrodes 154 and 154', and between electrodes 156 and 156'.

Figure 2:
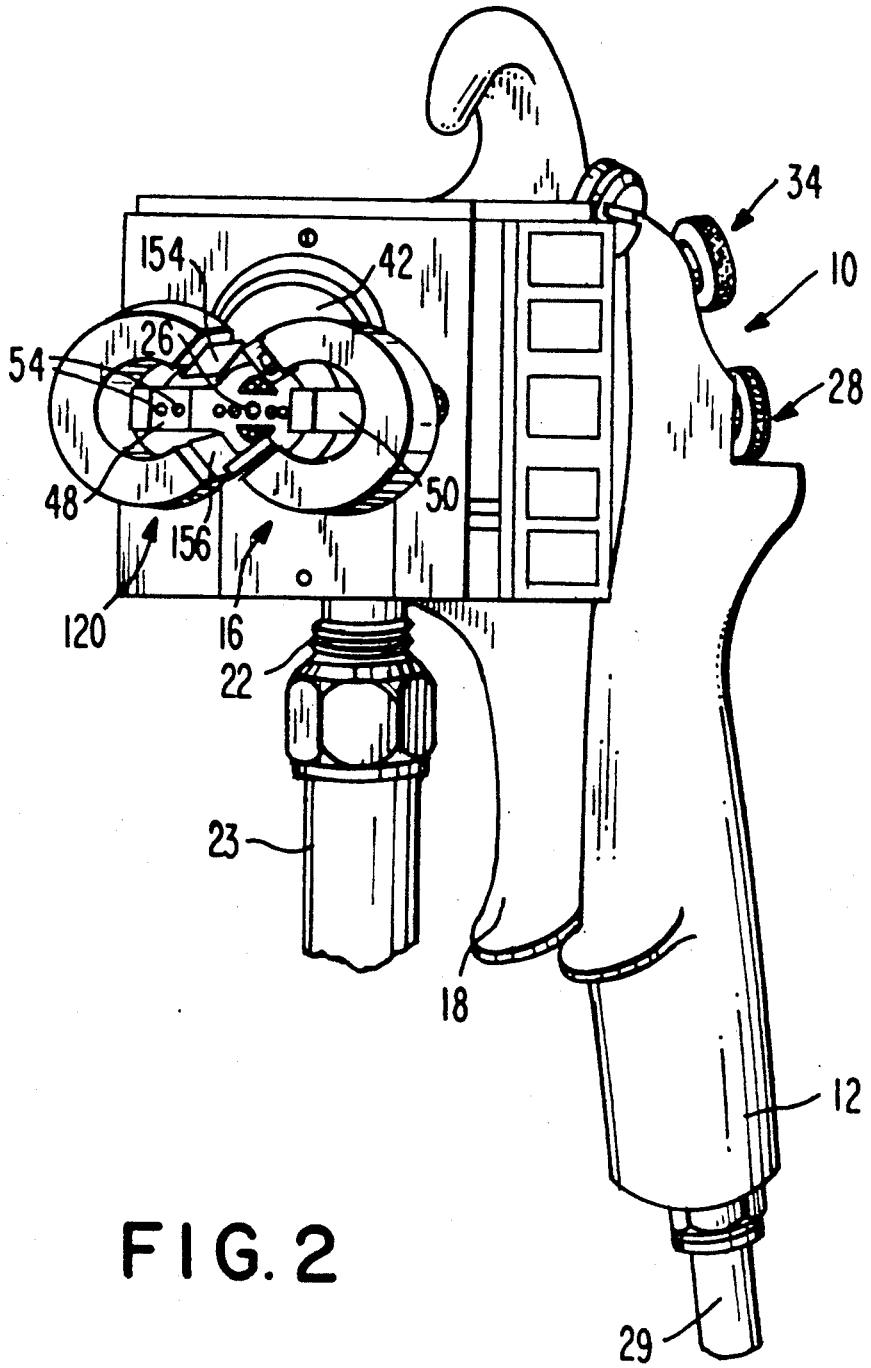
FIG. 2 is a front perspective view of the spray gun of FIG. 10, with the forward shield removed for clarity of illustration.
Figure 11:
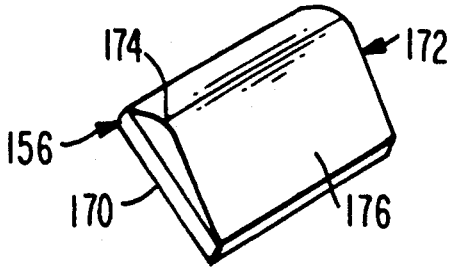
FIG. 11 is a perspective view of an electrode used in the adapter of FIG. 1.

As illustrated in FIGS. 2 and 11, the electrodes 154, 156, 154' and 156' are substantially identical, with exemplary electrode 156 being illustrated in perspective view in FIG. 11. The electrode consists of a base 170 of a dielectric material and a semiconductor coating 172. The coating 172 may vary in thickness in cross section, as illustrated in FIG. 4, having a thickened portion 174 at the rearward portion of the electrode nearest the air cap, with the semiconducting material 172 tapering outwardly and forwardly (in the direction of liquid flow along the spray axis) so that the electrode has an inner forward surface 174 which tapers way from the spray axis 158. As illustrated in FIGS. 5 and 6, each of the electrodes is similarly shaped to provide a symmetrical arrangement around the spray axis. The electrodes are mounted on the inner ends of the tip portions 150, 152 of the support head 122, as by means of suitable support posts illustrated in FIG. 6 at 180 and 182.

Although the electrode configuration of FIG. 11 is preferred, it will be understood that other configurations may be used. For example, the electrode may be formed from a tapered dielectric base shaped like the electrode 156, on which is carried a thin metallic film or coating having the desired surface shape. The forward surface 176 of the electrode is the active surface, and may have a shape other than the generally rectangular shape illustrated in FIG. 11. Furthermore, the active surface of the electrode may be surrounded by a dielectric bead to prevent flashover from the edges of the conductive or semiconductive material.

The electrode support heads 122 and 124 are illustrated as being generally planar, supported by posts 126 and 128 extending forwardly from plate 74. However, this structure is merely exemplary of a presently preferred form of the invention, and it will be understood that other support structures may be used to position the electrodes symmetrically around the spray axis and adjacent, but forward of, the air cap. Thus, for example, the support posts 126 and 128 can be angled with respect to the adapter housing, and the electrode supports need not be planar, nor do they have to be strictly C-shaped; the principal feature is the correct positioning of the electrodes with respect to the spray path so that charges will be provided on the atomized particles.

As illustrated in FIG. 4, each of the semiconducting electrodes, such as the electrode 156, is connected to the high voltage circuitry by way of a lead such as the lead line 184 passing through the support head 122 and by way of an individual current limiting resistor 186 mounted in the support post 126 which carries the corresponding support head. The current limiting resistor 186 is connected by way of lead 188 to the output line 110 of the high voltage circuit 82 of FIG. 9. The four electrodes 154, 156, 154' and 156' diagrammatically illustrated in FIG. 9 are each connected by way of a corresponding lead line extending through its corresponding support head and through a corresponding current limiting resistor in the support posts for the support heads for connection to the high voltage circuitry at line 110. The current limiting resistors for the individual electrodes serve to limit the current to each electrode so that the adapter remains operative even if one of the electrodes should become clogged and/or electrically short circuited. The provision of an additional current limiting resistor 108 for the output of the converter permits removal of the electrodes and the electrode supports from the adapter without the danger of short-circuiting the output of the converter, and without the danger of an intensive arc should the power supply be turned on after the electrodes and adapter plate have been removed from the spray gun.

When a metal air cap is used, it may be desirable to coat portions of the air cap 42 with a fused dielectric plastic powder such as Teflon to form a nonporous film two to ten mils thick. Teflon provides the combination of high dielectric strength and solvent and abrasion resistance required for a spray gun. Epoxy films or other dielectric coatings can be used, as long as the coating has good dielectric strength and is nonporous. Those portions of the cap which are nearest the electrodes may be coated to reduce flashover, although areas immediately adjacent the atomizing and the shaping ports 44, 45 and 54 would not normally be coated, since slight nonuniformities in the port shapes, as might be caused by such a coating, would cause the emerging air flows to be misdirected, producing a misshapen spray fan. Surprisingly, however, with the electrode arrangement of the present invention such a dielectric coating is not usually necessary, possibly since the flow of liquid from the spray nozzle during operation of the spray gun is sufficient to direct electrostatic fields away from the air cap, thereby suppressing flashover. During atomization, the surface of the conductive liquid contains many microscopic sharpened tips which serve to concentrate electric charges and deflect the electric field lines more into the path of the spray. In addition, the presence of a sharpened corona needle 190 (see FIG. 4) in the center of the flow path and equidistantly spaced from the electrodes also serves to direct the electrostatic field away from the air cap 42 when either a conductive or a nonconductive liquid is being sprayed. By thus establishing preferential electrostatic field lines in directions other than toward the air cap, flashover is suppressed. Additionally, the use of current limiting resistors restricts the amount of current available, thereby limiting the ability of the system to supply current to a large number of different locations, further reducing the tendency toward flashover. When a current path to the corona needle is established, the resistance of that path is reduced and the current tends to remain in that path, again suppressing flashover.

The electrode arrangement of the present invention permits use of the adapter not only with a metal air cap, but also with a conventional metal nozzle assembly, including the nozzle element 27 discussed above. In a preferred form of the invention, the nozzle 27 carries a small wire corona needle 190 which extends into and forwardly from the liquid exit aperture 26. The corona needle preferably is of small diameter, on the order of 10 mils or less, and may be made of stainless steel, spring steel, or beryllium copper wire. The needle may be secured by soldering it to a small hole or groove in the nozzle tip. The needle is electrically grounded by virtue of its direct contact with the metal nozzle and the electrically grounded liquid being sprayed, and is positioned so that it does not interfere with the closing and sealing function of the liquid needle valve 23. If a very small diameter flexible wire is used, for example, less than 3 mils, the action of the fluid stream will tend to pull it into position along the spray axis 158 when the spray gun is activated. Alternatively, the needle may be directly attached to the forward tip of the control needle 23. A larger diameter corona needle, for example, approximately 25 mils, could also be used if additional control over droplet formation, as by providing increased surface area, is required, providing that a sharpened tip is available to produce corona. Corona enhancement devices, such as Dendritic conducting or semiconducting elements attached or made part of the needle could also be used to provide a larger number of 1 to 10 micron radius tips as charge emitters to increase liquid charging efficiency.

In operation, a high DC potential is applied through the high series resistors 186 to the semiconducting electrodes 154, 154', 156 and 156' described above. The surface resistance, and the bulk resistance of the electrode material combine with the series resistor 186 to impede rapid charge transfer to any point on the electrode surface that might suddenly be brought in contact with ground potential, thus preventing an arc or spark which might be of sufficient energy to produce an explosion or fire when the spray gun is operated in a flammable atmosphere. The voltage supplied to each of the electrodes is typically 3 to 15 kV DC for an electrode spacing of about ½ inch from the spray axis 158, providing an average field gradient of about 6 to 30 kV per inch between the electrodes and fluid ejected from the nozzle aperture 26 and/or between the electrode and the corona needle 190. However, under some conditions, a gradient of between 1 and 50 kV per inch might be acceptable. Furthermore, it should be understood that in order to obtain the desired gradient, the applied voltage might be only a few hundred volts, or might be between 20 and 25 kV, depending on the nozzle and adapter configuration.

For most liquids, the high series current limiting resistance leading to the electrodes will tend to optimize the voltage gradient applied to the liquid in order to produce maximum induction charging without producing arcs or sparks between the electrodes and the corona needle or between the electrodes and the air cap. If the liquid conductivity is very high, as is the case with waterborne paint, the applied voltage must be held at the lower end of the range; for example 500 V DC to 5 kV, in order to maximize induction charging of the droplets while minimizing the possibility of corona emission from the surfaces of forming droplets. It has been found that if too high a voltage is applied to a conductive liquid, the charges will accumulate on small particles rather than larger particles, and this prevents the larger particles from becoming charged. The voltages in the lower part of the preferred range of voltages more effectively charges the larger particles. In the case of low conductivity liquids, such as paints thinned almost exclusively with solvents of very low polarity such as Xylene, on the other hand, it is desirable to maximize ion formation at the needle tip by operating in the upper end of the applied voltage range; for example, 10 to 20 kV.

The electrode voltage is controlled by adjusting the DC voltage input to the power supply, as by means of a potentiometer 192 in the power supply 82 (FIG. 9). However, the system can be used with or without the electrically grounded corona needle. When high conductivity fluids are being sprayed, the grounded corona needle serves no direct electrostatic charging function, although if it is of sufficient size to be relatively rigid during the spraying operation, the needle does function to provide more surface area for droplet formation and thus assists in the atomization process. The needle also tends to reduce the number of fine (less than 10 micron) droplets produced by the spray gun and thus contributes to a more uniform inductive charging of the spray even though it is not directly involved in that charging process. However, as the conductivity of the fluid is reduced, the corona needle increasingly serves the function of providing corona ions to charge the nonconductive liquid droplets, while the induction charging effect is correspondingly reduced.

Typically, the electrodes 120 are maintained at a positive potential while the corona needle is electrically grounded, thereby producing negatively charged droplets regardless of whether induction or corona is the charging mechanism. The polarity of the system may be reversed to produce positively charged droplets; however, negatively charged droplets are conventionally used in the coatings industry.

Figure 12:
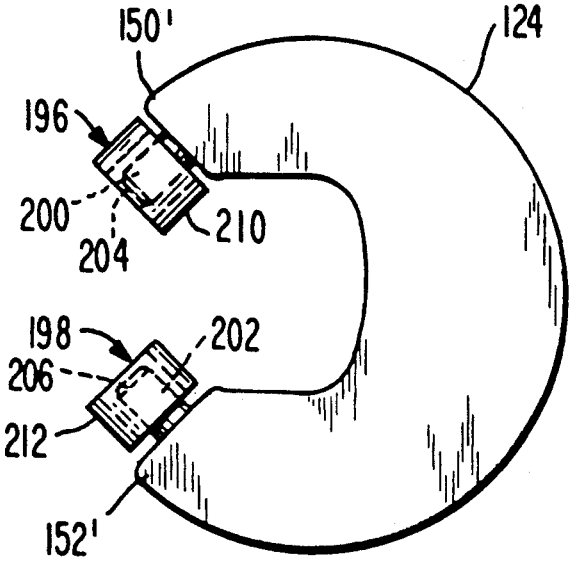
FIG. 12 is a front elevation of a modified adapter electrode support head with a modified electrode and shield structure.
Figure 13:
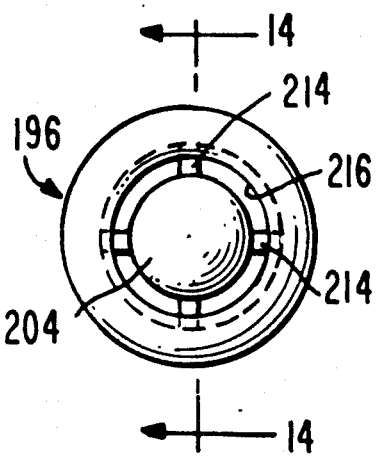
FIG. 13 is a front view of the electrode and shield of FIG. 12.
Figure 14:
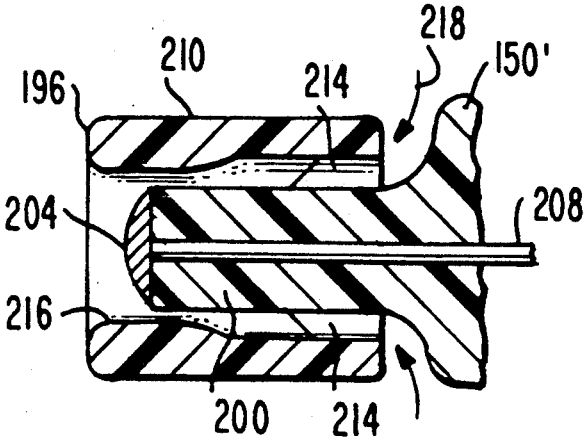
FIG. 14 is a cross sectional view taken along line 14—14 of FIG. 13.

FIGS. 12, 13 and 14 illustrate a second form of the charging electrode of the present invention. As there illustrated, the C-shaped electrode support head 124 carries at its distal ends 150' and 152' a pair of electrode assemblies 196 and 198. These assemblies include cylindrical support posts 200 and 202 which extend inwardly, with the axes of the posts and intersecting the spray axis 158 of the spray gun. At the free ends of the support posts are mounted generally circular electrodes 204 and 206. As illustrated in FIG. 14 for assembly 196, the electrodes are connected by way of leads such as lead 208 to corresponding current limiting resistors and then to the power supply in the manner described hereinabove. Surrounding electrodes 204 and 206 and their corresponding support posts are cylindrical dielectric shields 210 and 212, respectively. The shields are mounted on supports 214 secured to the posts 200 and 202, respectively, to secure the shields coaxially with their corresponding support posts. As illustrated in FIGS. 13 and 14 for assembly 196, the inner surface of the shield 210 is tapered inwardly to form a nozzle like restriction in the region 216 adjacent the electrode 204 to provide a high velocity air flow in that region. The remaining electrode assemblies are similarly constructed.

During the operation of the spray gun, air is drawn into the rear of the tubular shield 210, as indicated by the arrow 218, flows along the length of the support post 200 and passes through the restricted area 216, the restriction causing a substantial increase in the velocity of the air drawn through the shield structure to thereby discourage droplet accumulation on the electrode. The dielectric shield 210 additionally serves the function of limiting flashover between the electrode and the metal air cap on the spray gun.

In the preferred form of the invention, a grounded protective shield, such as the shields illustrated at 220 and 222 in FIGS. 1, 3, 4, 6 and 7 are mounted on the forward face of each of the C-shaped electrode support heads by means of spacers 224, 226, 228 and 230. The shields are omitted from FIGS. 2 and 5 in order to better illustrate the electrode support plates. The shield 220 consists of a generally C-shaped dielectric backing plate 232 which is substantially the same size as the electrode support head 122, and a conductive shielding plate 234 secured, as by means of a suitable adhesive, to the front face of the dielectric backing plate. The shielding electrode 234 is also C-shaped and is approximately the same size as the backing plate. The ground shield 222 similarly is constructed of a backing plate 236 covered by an electrically conductive shielding electrode 238.

As illustrated in FIG. 4, the conductive ground shields 234 and 238 are electrically grounded so that they cooperate with the electrodes mounted on the support heads 122 and 124 to produce a nonuniform field which extends in front of the ground shields 234 and 238, as indicated by the arrows 240 and 242, and around the C-shaped support heads. This field tends to deflect charged droplets which might otherwise move away from the spray axis in the direction of the shields, back toward the axis, and helps to produce a better spray pattern. The field also prevents the accumulation of charged particles on the support heads and other structures containing high voltage elements Furthermore, the shields prevent the high voltage elements of the spray gun from coming into contact with the workpiece or with other grounded objects, to thereby prevent flashover and to prevent injury to the operator of the spray gun.

Although the ground shield is illustrated as a flat plate, it will be understood that other shapes may equally well be used. For example, the shield may be curved rearwardly around the outer edges of the C-shaped support plates 122 and 124 to shield the edges of these plates. Although variations in the shield configuration may change the field lines somewhat, the shield will still serve to discourage the accumulation of paint or other sprayed particles on the electrodes and supports, thereby reducing the slugging of paint onto a workpiece. It should be understood that the adapter can be operated without the shields, but this may result in a high accumulation of spray droplets.

Figure 15:
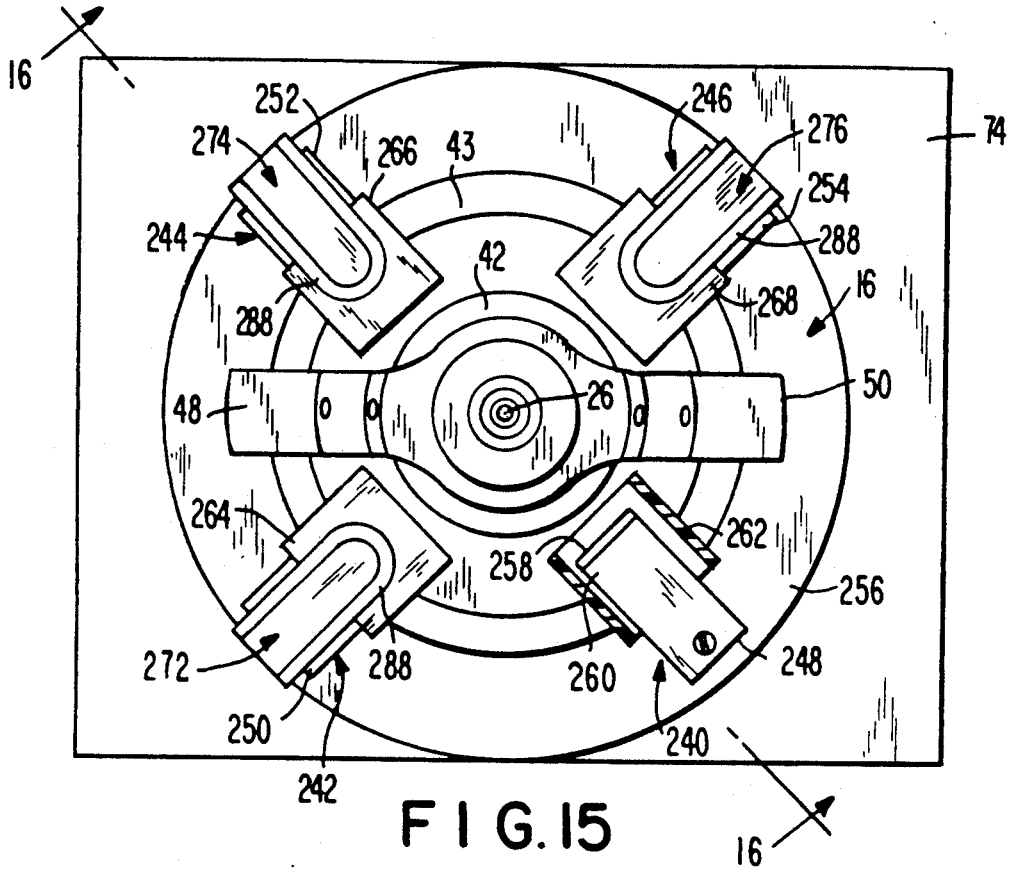
FIG. 15 is a partial front plan view of another modified adapter electrode assembly.
Figure 16:
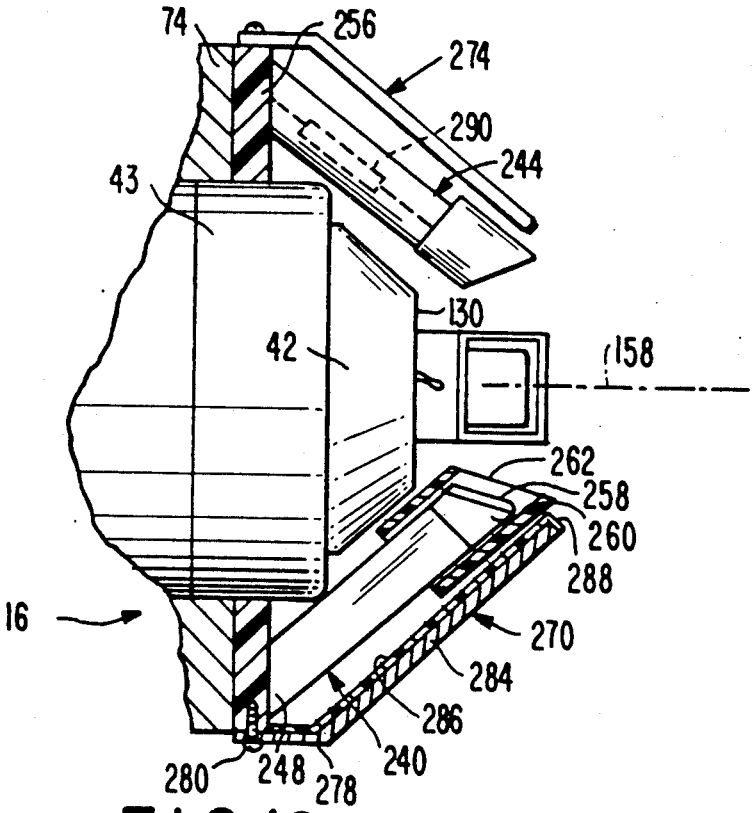
FIG. 16 is a partial sectional view taken along line 16—16 of the assembly of FIG. 15.

A modified form of the support heads for the electrodes of the present invention is illustrated in FIGS. 15 and 16, wherein the electrode mounting assembly 120 includes a plurality of individual support heads 240, 242, 244 and 246. These support heads are elongated and are secured at rearward ends 248, 250, 252 and 254, respectively, to an annular face plate 256 secured to the spray gun, and extend forwardly and inwardly past the plane of the nozzle 26 and past the face 130 of the air cap (FIG. 16). In FIG. 16 the air cap is illustrated without the air horns 48 and 50 for clarity of illustration of the support heads. The support heads carry corresponding electrodes, such as electrode 258 on support 240, on their inner, distal or free ends, such as end 260. The support heads may be angled inwardly as illustrated, or may be slightly curved to position their corresponding electrodes around and near the spray axis 158 of the nozzle. The inner ends 260 of the support heads preferably are surrounded by dielectric shields 262, 264, 266 and 268, respectively, which are similar to the shields 210 illustrated in FIGS. 13 and 14.

Ground shields, such as the shields 222 in the embodiment of FIG. 4, may also be provided for the electrode arrangement of FIGS. 15 and 16, as illustrated by ground shields 270, 272, 274, and 276. Each shield is an elongated finger, and as exemplified by shield 270 in FIG. 16, is connected at its rearward end 278 to the spray gun, as by a fastener 280 secured to face plate 256. The finger-shaped shields 270, 272, 274 and 276 extend forwardly and inwardly toward spray axis 158, and are spaced above, and are generally parallel to, corresponding support heads 240, 242, 244 and 246, respectively. The ground shields are preferably formed of a metal sheet 284 with its lower surface covered by a dielectric coating 286. The edges of the metal sheet are covered by a dielectric epoxy bead 288.

The support heads each incorporate a resistor such as resistor 290 for connecting the respective electrodes to a high voltage power supply, as discussed above with respect to resistor 186. The power supply preferably is mounted in a housing carried by the spray gun, but in some cases it may be preferable to utilize a power supply which is not mounted on the gun. Such a separate power supply may incorporate solar panels, as described above, and will provide sufficient voltage to produce the voltage gradient required to charge the spray particles.

Although the electrodes 258 carried on the support heads are illustrated as being symmetrical with respect to the spray axis 158, it will be understood that other arrangements may be used, as long as the required voltage gradients are provided. The symmetrical arrangement of individual electrodes is particularly convenient for use with an air-assisted spray gun, where air horns are used to control the spray pattern although such symmetry is not always necessary. However, in cases where electrostatic charging of particles is used in spray guns which do not use air horns, the electrode arrangement can be nonsymmetrical. Thus, the four support heads illustrated in FIGS. 15 and 16 need not be spaced at 90 degree angles around the spray axis, and they need not all be spaced the same distance from that axis. Furthermore, it is not necessary, in such cases, to provide multiple spaced electrodes; instead, a single, annular electrode may be provided, as illustrated in FIGS. 17 to 20, to which reference is now made.

Figure 17:
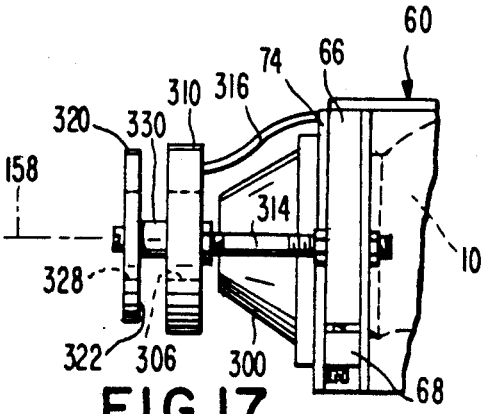
FIG. 17 is a partial side view of a spray gun and modified adapter.
Figure 19:
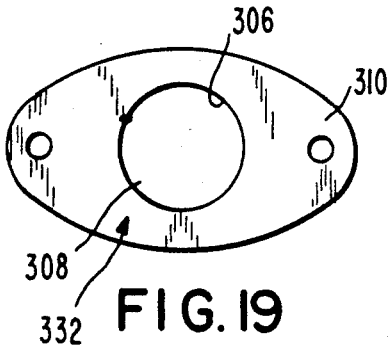
FIG. 19 is a front elevation of the annular electrode of the FIG. 17 adapter.
Figure 18:
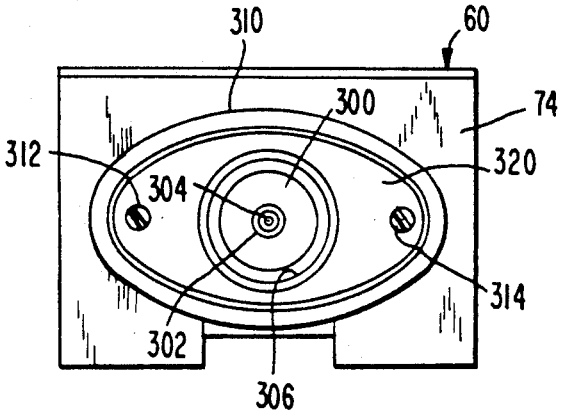
FIG. 18 is a front view of the device of FIG. 17.

In the embodiment of FIG. 17, the spray gun 10 is shown as incorporating the power supply housing 60 and the 2-part mounting plate 66, 68 which secures the housing to the spray gun. Adapter plate 74 is secured to the mounting plate 66, as previously explained. In the illustrated embodiment, the spray gun carries an air cap 300. This air cap does not include the air horns illustrated in prior embodiments, but is of the type which includes air passages 302 surrounding a liquid nozzle 304, as is known in the art. Alternatively, the air outlets can be omitted and the atomization of the liquid carried out by hydraulic pressure, again as is known. An annular electrode 306 surrounds the spray axis 158 of the spray gun 10. The electrode is generally cylindrical and has its axis parallel to and preferably coaxial with the spray axis 158. Preferably, the electrode is formed as a semiconductive coating on the annular surface defined by an aperture 308 formed in an electrode plate 310. Plate 310 is illustrated in FIGS. 18 and 19 as being generally oval, and is mounted on the adapter housing 60 as by means of extended bolts 312 and 314. The electrode is connected to the high voltage source of power in the adapter housing as by means of a flexible cable 316.

Positioned in front of the electrode plate 310 is a ground shield 320 which preferably is of metal or other conductive material and which is connected to ground potential. The shield is coated on its back surface 322 with a dielectric material to prevent arcing between the electrode 306 and the shield 320, with the dielectric material extending around the peripheral edges of the shield to form beads 324 and 326 around the periphery of the shield 320 and around the periphery of a central aperture 326. This central aperture is coaxial with the aperture 308.

The ground shield 320 is preferably mounted on the bolts 312 and 314 and is held in parallel, spaced apart relationship with the electrode holder 310 by means of suitable spacers 330 (FIG. 17). The bolts 312 and 314 and the spacers 330 are constructed on an electrically insulating material so that they do not adversely affect the electric field surrounding the spray axis 158.

In a typical example, the semiconducting electrode surface may be one half to one inch in diameter with its axial length being about one fourth inch. If desired, a segment of the lower portion of the electrode support 310 and of the ground shield 320 may be cut away in the regions generally indicated at 332 and 334, respectively, to prevent the accumulation of liquid during spray operations.

Figure 21:
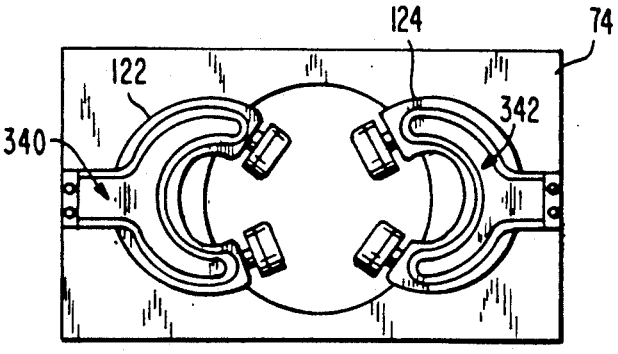
FIG. 21 is a front elevation of an electrostatic adapter having the C-shaped electrode supports of FIGS. 1-6, and having a modified Y-shaped ground shield.
Figure 20:
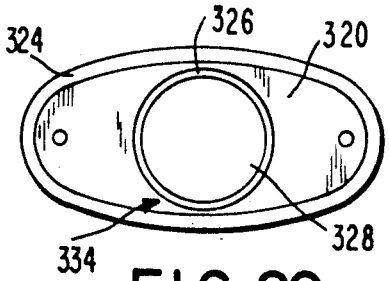
FIG. 20 is a front elevation of the ground shield used in the embodiment of FIG. 17.
Figure 22:
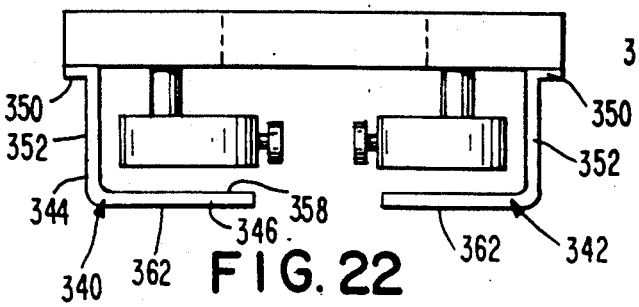
FIG. 22 is a top plan view of the device of FIG. 21.
Figure 23:
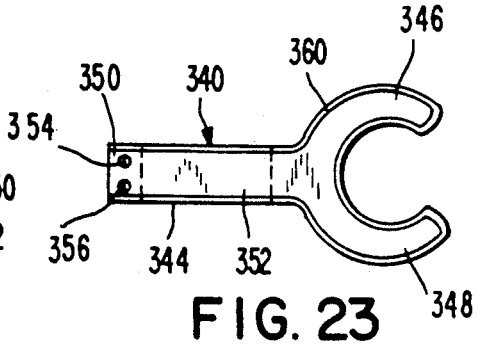
FIG. 23 is a front elevation view of a metal stamping from which the shield of FIG. 21 is formed.

The ground shields illustrated in FIG. 6, for example, may be modified as illustrated in FIGS. 21, 22 and 23. As there illustrated, the C-shaped support heads 122 and 124 are mounted on plate 74 by means of suitable support posts in the manner previously described. In this embodiment, however, the ground shields are formed from generally Y-shaped metal stampings 340 and 342. Each of these shields is formed with a mounting leg portion 344 and a pair of curved leg portions 346 and 348 connected to one end of the leg portion 344. The portions 346 and 348 form a generally C-shaped shield portion which is adapted to cover the front surface of the C-shaped electrode support heads 122 and 124 as illustrated in FIG. 21. The leg portion 344 is bent as illustrated in FIG. 22 to provide a base portion 350 and a riser portion 352 by which the C-shaped shield portion is positioned in front of the electrode support heads. The base portion 350 is secured to the adapter plate 74, by means of suitable screws 354 and 356, while the riser portion 352 extends forwardly from the support plate 74 to position the shield portion in front of the electrode support heads. A thick dielectric coating covers the back surface 358 of the shield elements 340 and 342 and extends around the edges of the metal stamping to form a bead 360 which prevents corona and arcing at the edges of the shield. The bead 360 may extend forwardly over the front surface 362 of the shield in the manner illustrated in FIG. 23. This dielectric coating may be an epoxy or other suitable material.

The electrostatic adapter of the present invention is illustrated as being an "add on" device which may be used to modify conventional spray guns and to produce a commercially useful degree of spray charging. It is will be understood, however, that the charging system could be an integral part of a spray gun, while retaining the advantages of the described electrode configuration. The use of the inventive features as an adapter is preferred, however, to keep the manufacturing costs low, so that the cost to the purchaser of a spray gun plus an adapter will be significantly lower than conventional electrostatic guns alone. The adapter is self contained, light in weight and made of a durable, solvent resistant material with good dielectric properties.

The design of the adapter preserves the advantages and operational characteristics of conventional spray guns, and permits effective spraying of all types of paints, including metallic paints, lacquers, and water based paints onto a wide range of substrates, with high efficiency. The adapter is also capable of charging and spraying a wide variety of commercially important liquids, including water based and solvent-based organo-metallic pyrolytic spray solutions to form high temperature glass coatings, solar films, and superconducting films with significantly increased application efficiency and improved uniformity. The conductivity of the liquid to be sprayed is not critical since the adapter provides both corona discharge and inductive type electrostatic charging. The device has a low inherent capacitance and uses a relatively low voltage, as compared to conventional electrostatic guns, and this, plus the electrode design and the dissipative nature of the resistive material used for the electrode element, minimizes the possibility of arcing or sparking in flammable atmospheres. The C-shaped mounting arrangement for locating the charging electrodes with respect to the spray axis of the spray gun permits vertical or horizontal orientation of the air spray cap without adversely affecting the charging efficiency.

It has been found that the highest spray charging efficiency is generally produced with either all plastic air caps or with metal air caps with a partial dielectric coating In the latter case, small areas around the air orifices are left uncoated so that the air pattern is not distorted. All metal caps are preferred, although charging efficiency may be reduced in some instances by 20 to 30 percent. In regions of the metal cap where exposed metal is within about ¼ inch of a live portion of the charging electrode, some form of dielectric shield, such as Teflon tape, can be interposed to improve charging efficiency and to minimize flashover tendencies. The dielectric shield can touch either the air cap or the electrode structure, but not both. Alternatively, a shield such as that illustrated in FIGS. 12, 13 and 14, or one interposed between the air cap and the electrode that does not contact either the air cap or the electrode can be used. The use of commercially available air caps with minimal modifications is preferred, since such caps are low cost, and are readily available in a large variety of configurations for different spray coating requirements. Furthermore, metal air caps without modification are quite satisfactory when used with conductive liquids such as waterborne paints at lower voltages of about 6 kV or less.

The resistance between the power supply and the electrodes should be between about 500 Megohms and 1,000 Megohms. Such a resistance is high enough to impede charge flow in an arcing or electrode shorting situation, but is low enough to permit slight losses through glowing at the electrode corners, for example, without significantly reducing the spray charging capability of the device. In the optimum configuration illustrated in the drawings, the series resistance to the electrodes includes both the limiting resistor 108 and individual electrode resistors 186 for each electrode surface, so that if one electrode experiences a shorting condition, the others will be relatively unaffected. In addition, a shunt, or load resistor, of about 100 to 1,000 Megohms provides a rapid discharge of the electrodes when the power supply is turned off.

The adapter of the present invention cooperates with an atomization zone for a spray gun wherein spray droplets are created at least in part by the mixing of liquid and air with high relatively velocities at their interfaces. It will be understood, however, that the atomization could be performed by other methods, such as bubbling, vibration, or even electrical disruption. The adapter provides in the atomization zone a charging field which extends between one or more semiconducting electrode surfaces at high voltage and an electrically grounded structure such as a sharp needle point or a conductive liquid nozzle tip. In accordance with the present invention, this charging field is concentrated in a region which is roughly cylindrical, the cylinder being about = inch in diameter and extending from about 1/16 inch in front of the face of the grounded metal fluid nozzle and extending forwardly past the electrodes, and centered on the spray axis. It will be noted that the rear edges of the electrodes are spaced forwardly of the spray nozzle face in order to provide the charging zone at the desired location along the spray axis.

Although the present invention has been described in terms of a preferred embodiment, it will be apparent that numerous modifications and variations may be made without departing from the true spirit and scope thereof, as set forth in the accompanying claims.

What is claimed is:

1. An adapter for electrostatic charging of particles produced by a spray gun having a spray nozzle for spraying an atomized liquid forwardly along a spray axis and having an air cap on the nozzle, the air cap having a forward surface and having at least one port for directing air under pressure toward the atomized liquid for further atomization and for directing the spray pattern, comprising:

an electrode assembly having an axis, said assembly including electrode means around said axis;

means for connecting a high voltage of known polarity to said electrode means to produce a charging zone in the region of said axis; and means for mounting said electrode assembly on a spray gun to locate said electrode means forwardly of the forward surface of the air cap and coaxial with a spray axis of the spray gun to space said electrode means close to the spray axis to produce an electrostatic field gradient in said charging zone coaxial with the spray axis and in the path of liquid sprayed from a spray gun on which said electrode assembly is mounted to charge the liquid particles to the opposite polarity as said high voltage.

2. The adapter of claim 1, wherein said means for mounting said electrode assembly includes securing means for engaging a spray gun and support means connected to said securing means for positioning said electrode means sufficiently close to a spray gun nozzle and air cap to produce in said charging zone around a nozzle spray axis a radial electrostatic field gradient sufficient to produce charges on liquid sprayed from a nozzle, but spaced sufficiently far from a nozzle and air cap to suppress flashover.

3. The adapter of claim 2, wherein said means for mounting said electrode assembly further includes housing means connected to said securing means for mounting said housing on a spray gun, and high voltage power supply means carried within said housing means, said adapter further including means connecting the high voltage from said power supply to said electrode assembly.

4. The adapter of claim 3, wherein said electrode assembly is removably connected to said securing means.

5. The adapter of claim 4, further including dielectric shielding means for said electrode means.

6. The adapter of claim 5, wherein said shielding means is a ground shield mounted to said electrode assembly to prevent contact and consequent flashover and arcing between said electrode assembly and a workpiece.

7. The adapter of claim 5, wherein said shielding means includes dielectric means between said electrode assembly and a spray nozzle and air cap to prevent flashover.

8. The adapter of claim 5, wherein said electrode means includes a plurality of electrodes and wherein said shielding means includes a dielectric shield element on each of said plurality of electrodes to prevent flashover.

9. The adapter of claim 8, wherein said dielectric shield element is a cylindrical shield surrounding each of said electrodes.

10. The adapter of claim 1, wherein said electrode assembly includes four spaced electrodes symmetrically spaced around said spray axis, said electrodes being sufficiently close to said spray axis to produce a field gradient of between 6 and 30 kV per unit with an applied voltage of less than about 20 kV to said electrodes.

11. The adapter of claim 10, wherein said means for mounting said electrode assembly includes:

a housing including a mounting plate assembly for securing said adapter to a spray gun;

a pair of electrode support heads, each carrying a pair of said electrodes; and means removably securing said support heads to said mounting plate assembly.

12. The adapter of claim 11, further including high voltage power supply means mounted in said housing and connected to said electrodes to produce said field gradient.

13. The adapter of claim 12, further including solar cell means on said housing and connected to supply electrical power to said power supply.

14. The adapter of claim 12, further including battery means mounted in said housing and connected to supply electrical power to said power supply.

15. The adapter of claim 14, further including solar cell means on said housing and connected to supply electrical power to said batteries.

16. The adapter of claim 11, wherein said means securing said support heads to said mounting plate assembly includes a plurality of support posts, at least one of said support posts for each said support head carrying electrically conductive means for connecting said electrodes to a source of voltage for supplying said voltage of less than about 20 kV.

17. The adapter of claim 16, wherein said electrically conductive means is a resistor.

18. The adapter of claim 16, wherein said source of voltage is a battery operated power supply in said housing.

19. The adapter of claim 11, wherein said mounting plate assembly includes clamping means.

20. The adapter of claim 11, wherein each of said electrode support heads is generally C-shaped and carries an electrode at each end, said support heads being secured to said mounting plate assembly so as to position said electrodes symmetrically around and close to a nozzle spray axis when said adapter is mounted on a spray gun.

21. The adapter of claim 20, wherein said electrodes are equally spaced from each other.

22. The adapter of claim 20, further including high voltage power supply means mounted in said housing, and circuit means connecting said power supply high voltage to each of said electrodes.

23. The adapter of claim 22, wherein said circuit means includes a current limiting resistor connected to each of said electrodes.

24. The adapter of claim 23, wherein said current limiting resistors are mounted in said electrode support heads.

25. The adapter of claim 23, wherein each said electrode comprises a dielectric base mounted on a corresponding end of one of said C-shaped support heads and a semiconductive coating material on said base.

26. The adapter of claim 25, wherein each said electrode is tapered to provide an active surface which extends longitudinally along a spray axis and tapers outwardly from the axis.

27. The adapter of claim 25, said adapter further including ground shield means mounted on said support heads.

28. Apparatus for electrostatically charging sprayed liquid particles through inductive charging of the particles and/or ion formation by corona discharge, comprising:

a spray gun having a liquid spray nozzle for atomizing a liquid and directing atomized liquid particles along a spray axis;

a needle in the path of said particles;

an electrode assembly including electrode means;

means for connecting a high voltage power supply of a first polarity to said electrode means;

means mounting said electrode assembly on said spray gun to position said electrode means around said spray axis to produce an electrostatic charging zone coaxial with said spray axis through which said atomized particles pass, said electrode means being located forwardly of said liquid spray nozzle and sufficiently close to said spray axis to cause a voltage applied to said electrode means to produce in said charging zone a radial electrostatic field gradient sufficient to induce charges on electrically conductive liquid particles and to produce a corona discharge to said needle to cause ions to accumulate on electrically nonconductive liquid particles so as to charge said particles to the opposite electrical polarity as the voltage applied to said electrode means, said electrode means being spaced sufficiently far from said nozzle to suppress flashover.

29. The apparatus of claim 28, wherein said spray gun includes a front face which lies in a plane normal to said spray axis, and wherein said electrode means is located closely adjacent, but does not intersect said plane, and wherein said spray nozzle and said electrode means lie on opposite sides of said plane.

30. The apparatus of claim 29, further including dielectric means interposed between said electrode means and said front face.

31. The apparatus of claim 29, wherein said electrode means is radially spaced from said spray axis by a distance of about ½ inch.

32. The apparatus of claim 29, further including a high voltage power supply mounted on said spray gun, and electrically conductive current limiting means connecting said high voltage power supply to said electrode means.

33. The apparatus of claim 32, wherein said high voltage is in the range of about 3 kV to about 20 kV.

34. The apparatus of claim 32, wherein said high voltage is sufficient to produce a voltage gradient of between about 6 and 30 kV per inch between said electrode means and said spray axis, and wherein said current limiting means reduce flashover and reduces free ions in said charging zone.

35. The adapter of claim 28, further including grounded shield means carried by said electrode assembly mounted means for preventing contact between said electrode means and a workpiece being sprayed and for producing electric fields which deflect said charged particles.

36. The apparatus of claim 34, wherein said electrode means comprises an annular electrically conductive electrode coaxial with said spray axis.

37. The apparatus of claim 34, wherein said means mounting said electrode assembly includes at least one electrode support head connectable to said spray gun, said support head including said electrically conductive means.

38. The apparatus of claim 34, wherein said means mounting said electrode assembly includes a plurality of electrode support heads each carrying a corresponding electrode, each said support head being mounted on said spray gun and configured to position its corresponding electrode adjacent said spray axis.

39. The apparatus of claim 28, further wherein said corona needle is aligned with said spray axis and cooperates with said electrode assembly to produce said radial electrostatic field gradient.

40. The apparatus of claim 39, wherein said coronoa needle is mounted on said liquid spray nozzle.

41. An adapter for electrostatic charging of particles produced by a spray gun having a fluid nozzle and having an air cap including a front surface for spraying atomized liquid forwardly along a spray axis wherein the liquid to be sprayed is a substantially ground potential, the adapter comprising:

an electrode assembly having a plurality of electrodes around and spaced from an axis;

means for connecting to said electrodes a high voltage of selected polarity with respect to ground potential, said voltage producing a charging zone between said electrodes and said electrode assembly axis;

means for mounting said electrode assembly on a spray gun to locate said electrodes forwardly of the front surface of the air cap of the spray gun and coaxial with the spray axis thereof and to space said electrodes sufficiently close to the spray axis to produce an electrostatic field gradient in said charging zone and between said high voltage and substantially ground potential which is sufficiently high to charge liquid particles passing through said charging zone to a polarity opposite to the polarity of said high voltage.

* * * * *